US008091295B1

(12) United States Patent
Lewis

(10) Patent No.: US 8,091,295 B1
(45) Date of Patent: Jan. 10, 2012

(54) MACHINE FOR CONSTRUCTING HEIGHT ADJUSTABLE STAIR STEPS

(76) Inventor: John Robert Lewis, Indian Mound, TN (US)

( * ) Notice: Subject to any disclaimer, the term of this patent is extended or adjusted under 35 U.S.C. 154(b) by 0 days.

(21) Appl. No.: 12/772,546

(22) Filed: May 3, 2010

Related U.S. Application Data

(63) Continuation of application No. 11/350,135, filed on Feb. 8, 2006, now abandoned.

(60) Provisional application No. 60/651,683, filed on Feb. 10, 2005.

(51) Int. Cl.
*E04F 11/00* (2006.01)

(52) U.S. Cl. ..... 52/183; 52/749.1; 182/223; 182/132

(58) Field of Classification Search ..... 52/183, 52/188, 749.1, 750, DIG. 1; 182/222, 223, 182/130–132
See application file for complete search history.

(56) References Cited

U.S. PATENT DOCUMENTS

| | | | | |
|---|---|---|---|---|
| 2,593,683 | A | 4/1952 | Lyons | |
| 2,888,182 | A * | 5/1959 | Nixon | 182/1 |
| 3,962,838 | A * | 6/1976 | Cox | 52/183 |
| 5,907,935 | A * | 6/1999 | Elena | 52/182 |
| 6,467,234 | B1 * | 10/2002 | Marshall | 52/741.2 |
| 6,868,944 | B2 * | 3/2005 | Truckner et al. | 182/228.1 |
| 2002/0088669 | A1 | 7/2002 | Truckner et al. | |
| 2005/0081461 | A1 * | 4/2005 | Gibson | 52/188 |

* cited by examiner

*Primary Examiner* — William Gilbert
(74) *Attorney, Agent, or Firm* — Young Basile Hanlon & MacFarlane P.C.

(57) ABSTRACT

A machine for constructing height adjustable stair steps with tread/riser unit, and riser bracket.

17 Claims, 6 Drawing Sheets

Figure 12
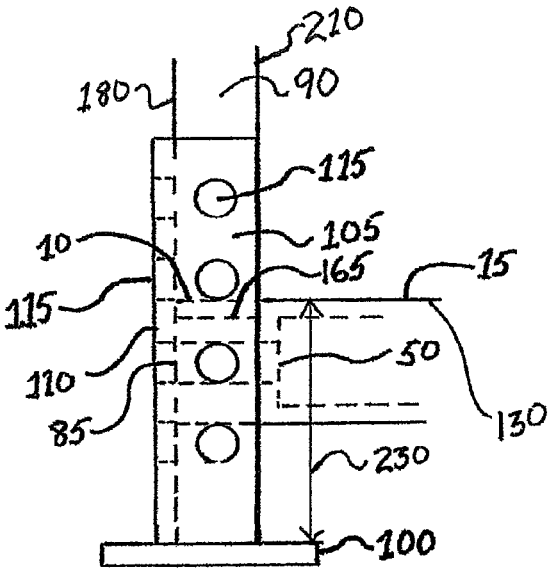
Figure 12
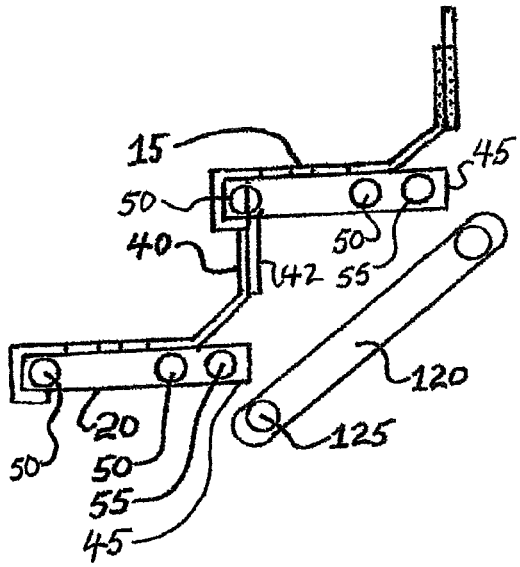
Figure 11
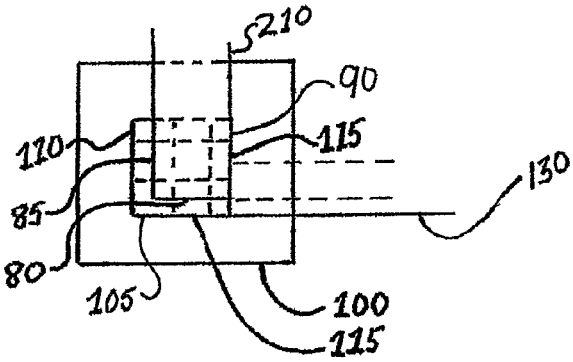
Figure 13

MACHINE FOR CONSTRUCTING HEIGHT ADJUSTABLE STAIR STEPS

CROSS REFERENCE TO RELATED APPLICATIONS

This application is a continuation of U.S. patent application Ser. No. 11/350,135, filed on Feb. 8, 2006, which claims the benefit of U.S. Provisional Patent Application Ser. No. 60/651,683, filed on Feb. 10, 2005.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of stairs and risers and more specifically to a machine for constructing height-adjustable stair steps.

U.S. Pat. No. 6,516,574 B1 by Couture discloses a staircase having metallic stringers, one of which is typically secured to half timbering, having temporary steps that are replaced later with permanent steps, and a vertical support attached to a framework by at least one horizontal support.

In substantial contrast to Couture, the instant art comprises no stringers, no vertical support attached to the framework of a building, and requires no temporary components.

U.S. Pat. No. 4,881,351 by Hamm discloses a staircase having U-shaped linking elements and steps attached to the linking elements by means of clamping joints. In addition, the erection of above disclosed staircase requires the on site drilling of holes.

In contrast to Hamm, the instant art requires no U-shaped elements and no clamping joints. In additional contrast to Hamm, the instant art requires no on site modifications.

U.S. Pat. No. 5,123,210 by Schmidt teaches a flight of stairs having a bottom step and a top step, both resting on an intermediate floor, a landing beam, or similar member. In addition, Schmidt also teaches at least one lateral end of each step arranged within a square support consisting of two horizontal and two vertical members, which, together, form a stair stringer in such manner that each step is supported by the assigned horizontal member beneath it, and such that each horizontal member extends beyond a vertical member which passes through the horizontal member, so that the extension of the upper horizontal member forms the lower horizontal member of the next step above it, while the extension of the lower horizontal member forms the upper horizontal member of the next step beneath it.

In contrast to Schmidt, the instant art teaches no bottom step or top step resting on an intermediate floor or any other member. In additional contrast to Schmidt, the instant art comprises no square support structure nor any arrangement wherein horizontal members comprise portions of two different steps nor any arrangement wherein vertical members pass through horizontal members.

U.S. Pat. No. 6,318,033 B1 by Birch et al. teaches a staircase repair device requiring an existing staircase and a new staircase construction having a plurality of stair tread members spanning between standard stringers.

In contrast to Birch et al., the instant art requires no existing staircase. In additional contrast to Birch et al., the instant art neither teaches nor requires standard stringers.

U.S. Pat. No. 5,502,933 by Skillern discloses a staircase construction comprising modules having a vertically oriented rectangular front member, a vertically oriented rectangular back member, a first horizontally oriented assembly diaphragm connecting a top of said back member to a top of said front member which diaphragm either serves as a step or supports a covering used as a step, and right and left side members attached to vertical ends of said front and back members. In addition, Skillern teaches one embodiment having a modular staircase supported by an underlying framework and one embodiment having a free standing staircase comprising modules with flanged support members connecting the front portion of a module to the rear portion of a module.

In contrast to Skillern, the instant art teaches no rectangular panels which support a step. In additional contrast to Skillern, the instant art requires no diaphragm member to connect the top of a front member to the front of a back member. In yet further contrast to Skillern, the instant art neither teaches nor requires an underlying framework nor flanged support members connecting the front portion of the module to the rear portion of the module.

U.S. Pat. No. 4,041,662 by Ward discloses a staircase construction having modules comprising brackets having four substantially parallel surfaces oriented substantially horizontally with the modules bolted together by means of vertically oriented holes in the substantially parallel surfaces which must be caused to align.

In contrast to Ward, the instant art teaches only one substantially horizontal surface. In further contrast to Ward, the instant art teaches no joining of modules by means of vertically oriented holes with bolts therethrough. In yet additional contrast to Ward, the instant art teaches joining of modules by means of brackets communicating with two surfaces rather than four.

U.S. Pat. No. 5,014,475 by Anderson, Jr. et al. teaches a staircase construction comprising modules bolted together and supported by stringers or by a stringer and another surface such as a wall. In addition, Anderson, Jr. et al. teach a tread portion which meets a riser portion to form a nosing, and a shoulder attached to the riser to support the tread portion.

In contrast to Anderson, Jr. et al., the instant art neither teaches nor requires stringers or other support structures. In additional contrast to Anderson, Jr. et al., the instant art neither teaches nor requires a tread portion to meet a riser portion to form a nosing nor a shoulder attached to the riser to support the tread portion.

U.S. Pat. No. 5,720,136 by Turner discloses a stairway construction comprising modules connected together to form a box beam with all modules connected by a longitudinal tension member to prevent separation of the modules under weight. In addition, Turner requires construction of the staircase from the bottom up and the addition of tread members as the last construction step after all modules have been connected.

In contrast to Turner, the instant art requires no box beam configuration nor any continuous longitudinal member communicating with all modules. In additional contrast to the instant art, since Turner teaches installation of tread elements and the longitudinal member on site after all modules are connected, the Turner modules cannot be fully assembled beforehand. This increases the time and labor required on site.

The instant art overcomes this limitation. In further contrast to Turner, the instant art is not limited to construction from the ground up.

U.S. Pat. No. 4,838,005 by Graham et al. discloses a staircase construction having stringer elements and tread pan elements into which a flowable material such as concrete is poured to form a tread portion. Also, Graham et al. teaches welding together of stringers and tread pan riser elements.

In contrast to Graham et al., the instant art neither teaches nor requires stringer elements nor the pouring of any flowable material. In additional contrast to Graham et al., the instant art does not teach the limitation of welding to connect tread and/or riser units to any other elements.

U.S. Pat. No. 705,794 by Snider teaches a spiral or curved staircase construction having pipes and various socketed pipe connectors configured as flange sockets, L-sockets, or T-sockets.

In contrast to Snider, the instant art is not limited to spiral or curved staircase construction. In further contrast to Snider, the instant art is not limited to pipe construction and comprises no socketed elements.

U.S. Pat. No. 1,547,254 by McClure discloses a spiral stairway having a central column.

In contrast to McClure, the instant art is not limited to spiral stairway construction. In further contrast to McClure, the instant art neither teaches nor requires a central column.

U.S. Pat. No. 4,850,164 by McLeod discloses a stair construction having at least one stringer having a plurality of treads supported on the stringer. In addition, McLeod teaches that the stringer must be capable of being trimmed away either in a manner that would alter the dimensions of the staircase or in a manner that would not alter the continuity of the shape of the staircase.

In contrast to McLeod, the instant art neither teaches nor requires a plurality of treads to communicate with one stringer. In additional contrast to McLeod, the instant art requires no trimmable elements.

U.S. Pat. No. 990,701 by Burge describes a structure of the fire escape classification and class with one side attached to a wall. In addition, Burge teaches rails from which are suspended hangers which support cross rods. Also, Burge teaches a sheet of flooring material extending over some cross rods and below others.

In contrast to Burge, the instant art is not limited to fire escapes and is not limited to being attached to a wall or any other building structure. In additional contrast to Burge, the instant art is not supported by or suspended from rails and neither teaches nor requires any sheet to pass over some cross elements and under others.

U.S. Pat. No. 3,556,251 by Whitehead discloses a prefabricated staircase having at least one parallelogram truss having an upper chord and a lower chord. The upper chord comprises holes for pivot points which support a plurality of panel members. In addition, the upper chord provides stiffness to resist compression as the staircase bears weight. The lower chord has holes for pivot points situated at intervals to correspond with those in the upper chord so that the lower chord can support panel members. The lower chord also provides resistance to tension caused by a load on the staircase.

In contrast to Whitehead, the instant art teaches no element to support a plurality of panels nor any continuous elements to bear stress. In addition, the instant art neither teaches nor requires any elements to pivot in relation to any others.

U.S. Pat. No. 4,798,030 by Molinazzi teaches a modular support for staircase steps having a box-like body with a male portion and a female portion on opposite sides whereby individual modules communicate. Molinazzi also teaches a first headpiece extending from the male portion upon which a step may be mounted and a second headpiece extending from the male portion at the end opposite the first headpiece so that when male and female portions communicate, screws can be inserted vertically through the headpieces of the male portion into the female portion of a communicating module to hold both together. In addition, Molinazzi teaches tooth means projecting from the male portion and the female portion, by which connection angles may be selected.

In contrast to Molinazzi, the instant art neither teaches nor requires male and/or female elements to affect communication between modules. In further contrast to Molinazzi, the instant art comprises no head pieces or tooth means and requires no vertical screws to join modules together.

U.S. Pat. No. 4,516,367 by Molinazzi discloses a modular support for stairway steps comprising cylindrical elements having convex sides and concave sides whereby the cylindrical elements communicate. In addition, Molinazzi teaches clamping elements to hold communicating cylindrical elements together.

In contrast to Molinazzi, the instant art is not limited to cylindrical elements, neither teaches nor requires communication between convex and concave elements, and neither teaches nor requires any clamping elements.

U.S. Pat. No. 4,520,897 by Gebo teaches portable steps supported by and in contact with the ground and using spikes to attach the steps directly to the ground.

In contrast to Gebo, the instant art neither teaches nor requires that the steps contact the ground and requires no spikes to attach steps directly to the ground.

U.S. Pat. No. 4,296,577 by Schuette and U.S. Pat. No. 4,373,609 by De Donato disclose stringers which support stair treads.

In contrast to Schuette and De Donato, the instant art neither teaches nor requires stringers.

U.S. Pat. No. 3,474,882 by Ernst teaches a stringer structure for supporting a staircase, scaffold, or similar structure.

In contrast to Ernst, the instant art neither teaches nor requires stringers.

BRIEF SUMMARY OF THE INVENTION

The primary object of the invention is a standardized and broadly adaptable pre-fabricated stair kit.

Another object of the invention is simple, convenient stair construction at a substantially fixed slope for a wide range of heights with maximum economy of labor and material.

Another object of the invention is to allow riser heights to be selected separately and independently from overall height of completed staircase.

A further object of the invention is compatibility with a wide range of structures.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for constructing height adjustable stair steps comprising a tread/riser unit and a riser bracket.

BRIEF DESCRIPTION OF THE DRAWINGS

The drawings constitute a part of this specification and include exemplary embodiments to the invention, which may be embodied in various forms. It is to be understood that in some instances, various aspects of the invention may be shown exaggerated or enlarged to facilitate an understanding of the invention.

FIG. 11 is a side view of tread riser units and a module brace.

FIG. 12 is a front view of a first step support bracket communicating with a step module.

FIG. 13 is a top view of a first step support bracket communicating with a step module.

DETAILED DESCRIPTION-LIST OF COMPONENTS

| | |
|---|---|
| 15 | Tread surface of tread/riser unit |
| 17 | Tread/riser unit |
| 20 | Second bracket part of tread/riser unit |
| 22 | First metal part |
| 25 | Angled riser part of tread/riser unit |
| 27 | Tread/riser unit support flange |
| 30 | Front planar surface of tread/riser unit |
| 35 | First tread/riser unit |
| 38 | Second tread/riser unit |
| 40 | Second riser part |
| 42 | Riser plate |
| 45 | Brace flange |
| 47 | Riser unit |
| 48 | Riser bracket |
| 50 | Riser bracket support hole |
| 52 | clearance notch |
| 55 | Step module brace hole |
| 60 | Right side of tread/riser unit |
| 65 | Left side of tread/riser unit |
| 70 | Mid baluster |
| 75 | Balustrade |
| 80 | Connector hole |
| 85 | Riser bracket hole |
| 90 | Proximal baluster |
| 95 | Distal baluster |
| 100 | Base part of height variance bracket |
| 105 | Front part of height variance bracket |
| 110 | Side part of height variance bracket |
| 115 | Connector hole |
| 120 | Module brace |
| 125 | Brace bolt hole |
| 130 | Proximal end of tread riser unit |
| 135 | Distal end of tread/riser unit |
| 140 | Riser part corresponding connector holes of tread/riser unit |
| 145 | First riser bracket |
| 148 | Second riser bracket |
| 150 | Rise |
| 165 | First planar part of riser bracket |
| 180 | Proximal end of riser bracket |
| 185 | Distal end of riser bracket |
| 190 | Proximal end of first planar surface |
| 195 | Distal end of first planar surface |
| 200 | Riser bracket cross brace |
| 205 | Step module |
| 210 | First step module |
| 215 | Second step module |
| 225 | First step support bracket |
| 230 | First step height |

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
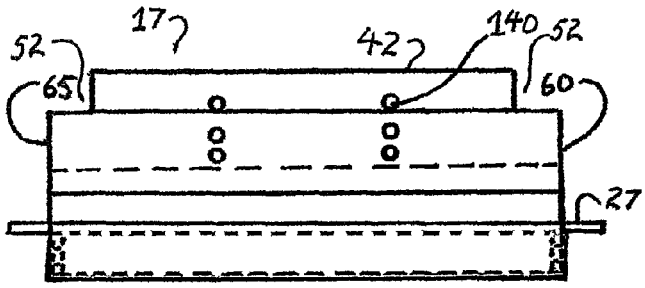
FIG. 1 is a front view of a tread/riser unit.
Figure 2:
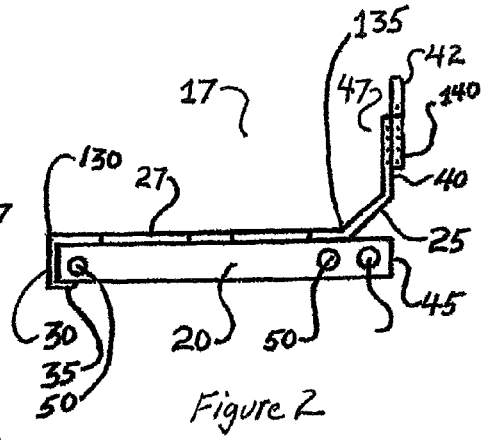
FIG. 2 is a side view of a tread/riser unit.
Figure 3:
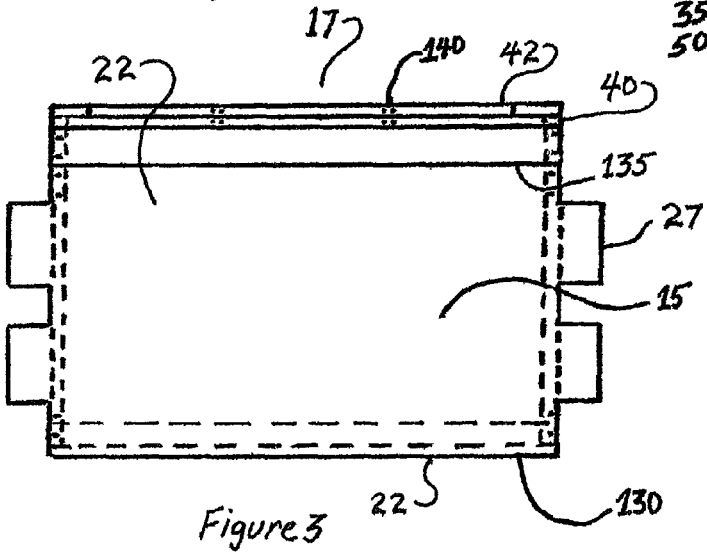
FIG. 3 is a top view of a tread riser unit.

Looking at FIG. 1, FIG. 2, and FIG. 3, we see a tread/riser unit (17) formed from a first part (22) of metal bent to shape having a left (65) and a right side (60) and forming a substantially planar tread surface (15) with proximal (130) and distal (135) ends. The tread/riser unit (17) also has a front planar surface (30) extending substantially perpendicularly downward from the proximal end (130) of the tread surface (15) with a bottom surface (35) extending from the front planar surface (30) substantially parallel to the tread surface (15) and toward the distal end (135) of the tread surface (15). The tread/riser unit (17) further comprises a substantially planar angled riser part (25) extending from the distal end (135) of the tread surface (15) at an obtuse angle relative to the tread surface (15) to a point at which a second riser part (40) extends upward from the angled riser part (25) substantially perpendicular to the tread surface (15).

Looking again at FIG. 1, FIG. 2, and FIG. 3, we see a riser plate (42) communicating with the second riser part (40) by means of connector holes (140) disposed in both the second riser part (40) and the riser plate (42) and aligned substantially coaxially so that the distance the riser plate (42) extends above the second riser part (40) may be varied by causing different holes (140) to align. Thus, a variable riser unit (47) is comprised having an angled riser part (25), a second riser part (40), and a riser plate (42).

Looking yet again at FIG. 1, FIG. 2, and FIG. 3, we see that the tread/riser unit (17) further comprises second bracket parts (20) having elongated substantially rectangular configurations connected to the first part (22) of the tread/riser unit (17) contiguous to both the right (60) and left (65) sides such that each second bracket part (20) is aligned substantially parallel to the sides (60 and 65) and extends downward substantially perpendicularly to the tread surface (15). In addition, we see that each second bracket part (20) abuts the front surface (30) and extends to a point on a line extending vertically down from the second riser part (40). Furthermore, we see that each second part (20) comprises riser bracket support holes (50) and also comprises a brace flange (45) having a step module brace hole (55).

Figure 4:
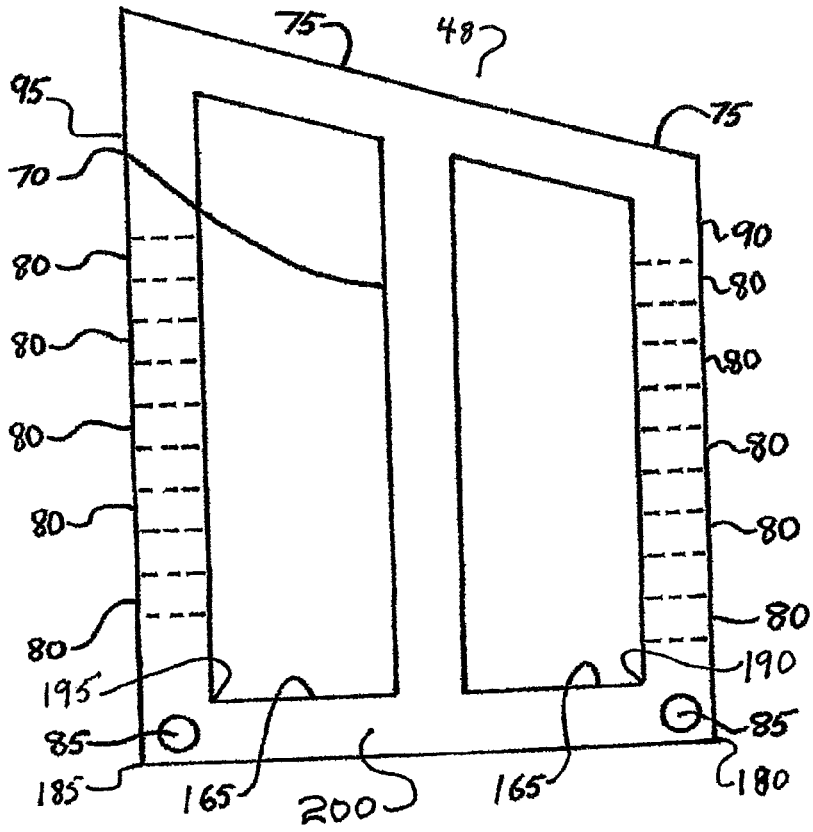
FIG. 4 is a side view of a riser bracket.
Figure 5:
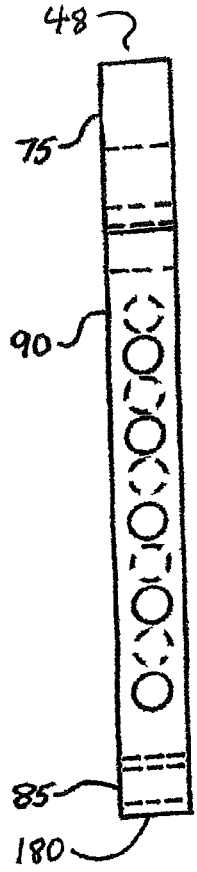
FIG. 5 is a front view of a riser bracket.

Turning now to FIG. 4 and FIG. 5 we see a riser bracket (48) having a proximal end (180) and distal end (185) and fabricated from tubular or solid metal or other substantially rigid material. In addition, we see that the riser bracket (48) has a riser bracket cross brace (200) which comprises a first planar part (165) having a proximal end (190) and a distal end (195). In addition, we see a proximal baluster (90) extending upward substantially perpendicularly from the first planar part (165), a distal baluster (95) extending substantially perpendicularly upward from the first planar part (165), and mid baluster (70) extending upwards substantially perpendicularly from the first planar part (165). We see that the balusters support a balustrade (75).

Looking again at FIG. 4 and FIG. 5, we see a plurality of connector holes (80) disposed in the proximal baluster (90)

and distal baluster (95), each hole penetrating along a line substantially parallel to the riser bracket cross brace (200). In addition, we see that the riser bracket cross brace (200) further comprises tread/riser bracket holes (85) near the proximal end (180) of the riser bracket (48) and at the distal end (185) of the riser bracket, each tread/riser bracket hole (85) penetrating along a line substantially perpendicular to the riser bracket cross brace (200) and substantially horizontal in relation to the tread surface (15).

Figure 6:
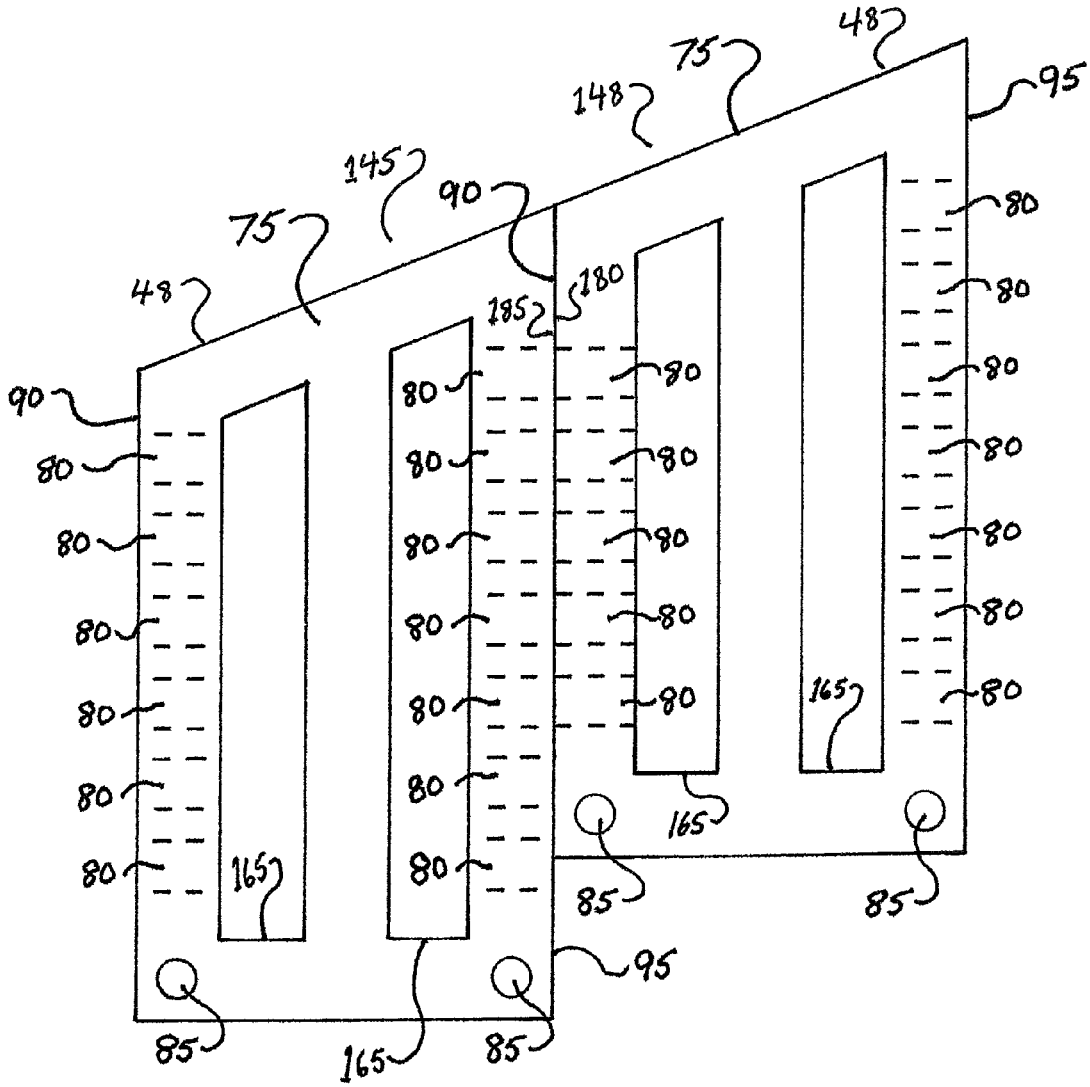
FIG. 6 is a side view of riser brackets communicating.

Turning now to FIG. 6, we see riser brackets (48) oriented so that the distal baluster (95) of the first riser bracket (145) abuts the proximal baluster (90) of a second riser bracket (148) so that the distal end (185) of the first riser bracket (145) abuts the proximal end (180) of the second riser bracket (148) in such fashion that connector holes (80) in the first riser bracket will align substantially coaxially with connector holes (80) in the second riser bracket. We can thus readily appreciate that with the connector holes (80) thusly aligned, the riser brackets (48) may be fastened together by bolts or an equivalent fastener inserted through the aligned connector holes (80).

Turning again to FIG. 6, we see that the chosen disposition of the first riser bracket (145) and second riser bracket (148) is such that the balustrades (75) are substantially co-linear; however, we can understand that such alignment is not required and that the balustrades (75) of associated riser brackets (48) need not be co-linear. Furthermore, we also realize that the balustrades (75) may be of any configuration; curved, for example.

Figure 7:
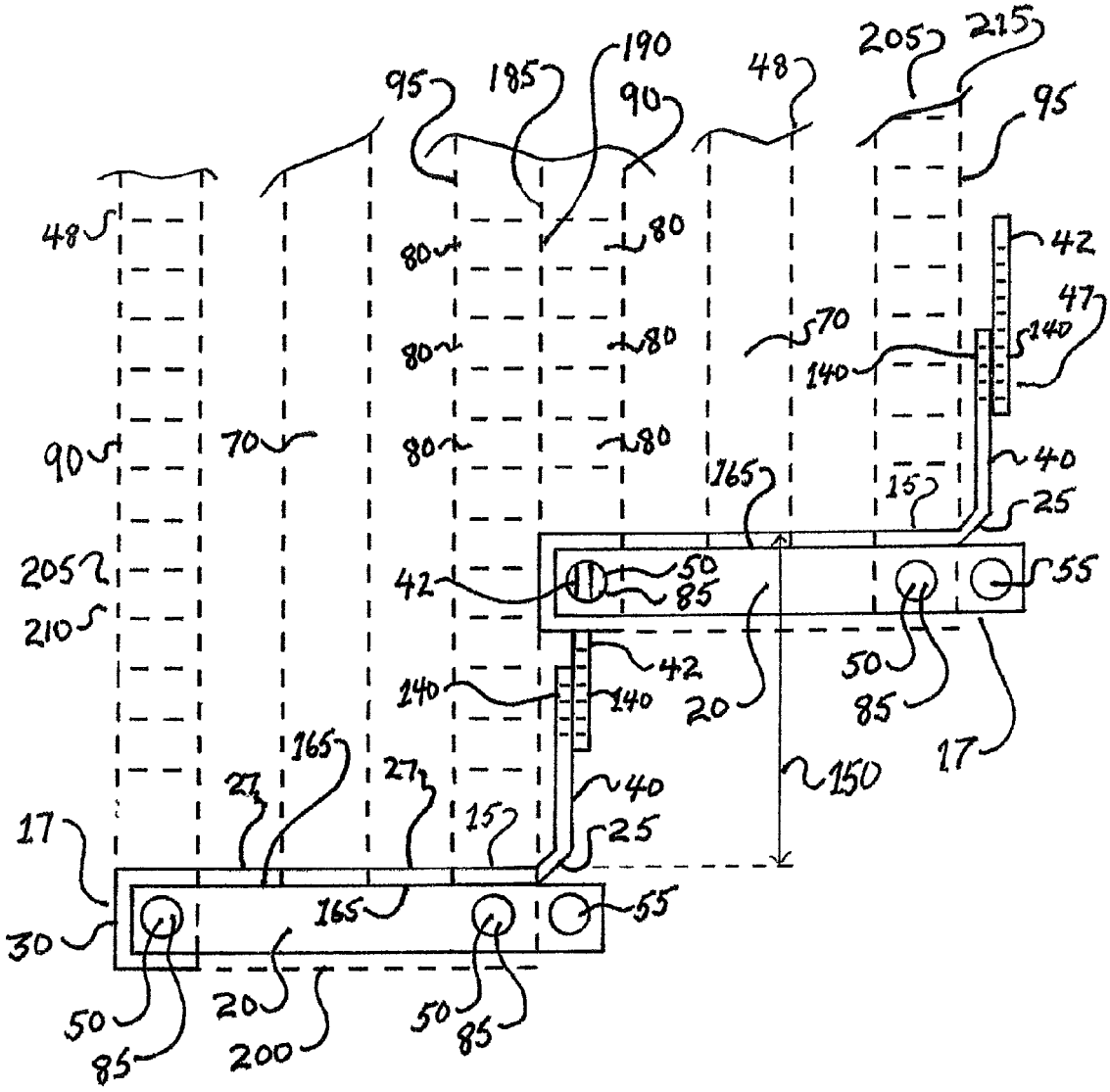
FIG. 7 is a side view of riser brackets, shown ghosted, communicating with tread/riser units.

Turning now to FIG. 7, we see tread/riser units (17) communicating with riser brackets (48) (shown in dotted lines) so that the riser bracket support holes (50) are aligned substantially coaxially with the riser bracket holes (85). We can readily appreciate that the tread/riser units (17) may be fastened together with the riser brackets (48) by bolts through the holes (50 and 85) thusly aligned or by an equivalent fastener to comprise a step module (205). Also, we see that the tread/riser unit (17) is supported by the tread/riser unit support flanges (27) resting upon the first planar part (165) of the riser bracket cross brace (200). However, those skilled in the art will readily appreciate that the bolts connecting the tread riser unit (17) to the riser bracket (48) are of sufficient strength to support more than the maximum weight that the tread surface (15) need be required to bear; therefore, the tread/riser unit support flanges (27) may be omitted.

Looking again at FIG. 7, we see a first step module (210) communicating with a second step module (215) such that one or more connector holes (80) in the first and second step modules (210 and 215) are aligned substantially coaxially so that the first step module (210) and the second step module (215) may be fastened together by means of bolts or equivalent devices.

Looking again at FIG. 7, we also note that the tread surface (15) of the first step module (210) and the tread surface (15) of the second step module (215) are substantially parallel so that the rise (150) is perpendicular from the plane of the tread surface (15) of the first step module (210) and to the plane of the tread surface (15) of the second step module (215). Now, we can readily appreciate that the rise (150) may be varied by aligning different connector holes (80) in the first step module (210) and the second step module (215).

Looking yet again at FIG. 7 and at FIG. 2, we see that as the rise (150) is varied, the riser unit (47) may be adjusted to accommodate the changes by means previously described.

Looking further at FIG. 7 and FIG. 1, we see that when the step modules are disposed as previously described, the riser plate (42) may occlude the space to be occupied by the bolts or equivalent devices. Therefore, to avoid this eventuality, the riser plate (42) or a portion of the riser plate (42) may be made narrower than the second riser part (40) so that when the second riser part (40) and the riser plate (42) communicate to comprise the riser unit (47), a clearance notch (52) will be comprised.

Figure 8:
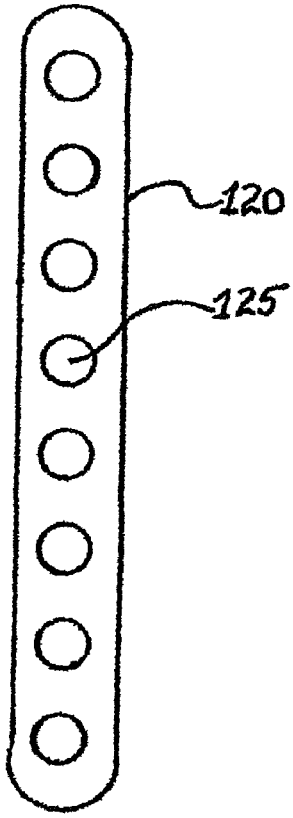
FIG. 8 is a module brace.

Looking now at FIG. 8 we see a module brace (120) having a plurality of brace bolt holes (125).

Looking also at FIG. 11, we see that if desired, the step modules communicating as previously described may be braced by aligning brace bolt holes (125) of a module brace (120) with the step module brace holes (55) in the brace flanges (45) of the tread/riser units (17) and inserting through the thusly aligned holes (125 and 55), bolts or equivalent fastener devices.

Figure 9:
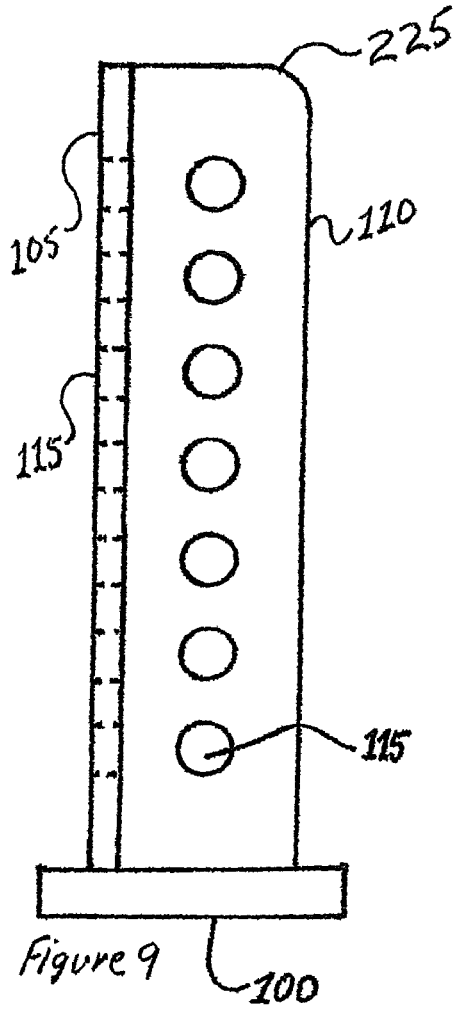
FIG. 9 is a side view of a first step support bracket.
Figure 10:
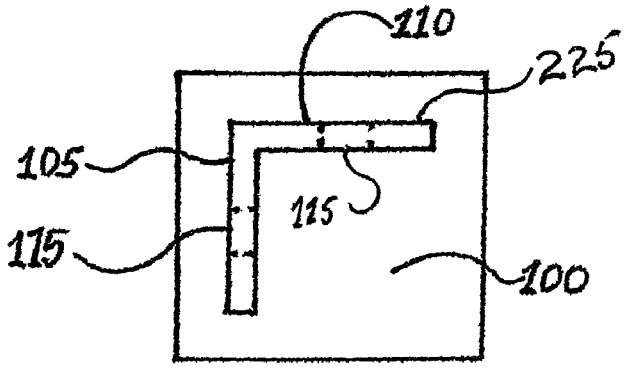
FIG. 10 is a top view of a first step support bracket.

Referring now to FIG. 9 and FIG. 10, we see a first step support bracket (225) having a base part (100) supporting a front part (105) and a side part (110). In addition, we see that the front part (105) and the side part (110) comprise substantially vertical rows of first step connector holes (115) and that the front part (105) and the side part (110) are connected at a substantially perpendicular angle.

Turning now to FIGS. 12 and 13, we see that the disposition of the first step connector holes (115) is contrived so that when the substantially coaxially aligned riser bracket support hole (50) and riser bracket hole (85) near the proximal end (180) of the riser bracket of the first step module (210) are both aligned substantially coaxially with the first step connector hole (115) in the side part (110) of the first step support bracket (225), the connector hole (80) in the proximal baluster (90) of the step module (210) will align with the first step connector hole (115) in the first front part (105) of the first step support bracket (225). Now, we can readily appreciate that the first step support bracket (225) and the first step module (210) may be connected by inserting bolts or equivalent devices through the previously described aligned holes.

Looking again at FIG. 12, we see that the perpendicular distance from the tread surface (15) and the base part (100) of the first step support bracket (225) comprises the first step height (230), and we can readily appreciate that the first step height (230) may be varied by aligning the riser bracket support hole (50) and the riser bracket hole (85) of a step module (210) with different holes in the first step support bracket (225). In addition, we can understand that the first step support bracket (225) may comprise attachment means to a surface.

Now, anyone skilled in the art can readily appreciate that by exploiting the instant art, a staircase may be constructed by preassembling modules and connecting them together on site and that the height of each step may be varied and the slope of the staircase may be varied.

Furthermore, anyone skilled in the art can readily appreciate that the angled riser part (25), the second riser part (40), and/or the riser plate (42) of the tread/riser unit (17) do not affect the strength, rigidity, or structural integrity of the step modules (205) and may therefore be eliminated if a staircase without risers or with partial risers is desired.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A modular staircase, comprising:

a plurality of step modules, each step module having:

a tread having a substantially planar foot engaging portion, a first support bracket disposed along a first lateral side of the tread, and a second support bracket disposed along a second lateral side of the tread, and a pair of riser brackets each having a lower member that is disposed at a bottom end of each riser bracket and extends from a front end of each riser bracket to a rear end of each riser bracket, front and rear balusters that are each connected to and extend generally upward from the lower member of each riser bracket at the front end and the rear end, respectively, of each riser bracket, wherein the lower member of each riser bracket extends along and is rigidly connected to a respective one of the first support bracket or the second support bracket of the tread and further wherein a plurality of connector holes are formed through the front and rear balusters of each riser bracket in a front-to-rear direction with respect to the riser brackets, and a balustrade that extends between and is connected to the front baluster and the rear baluster of each riser bracket at a top end of each riser bracket;

the plurality of step modules including at least a first step module and a second step module; and a plurality of fasteners that rigidly connect the rear balusters of the first riser step module to the front balusters of the second step module at a selected vertical position of a plurality of possible vertical positions of the first step module with respect to the second step module.

2. The modular staircase of claim 1, wherein the step modules of the plurality of step modules are substantially identical to one another.

3. The modular staircase of claim 1, wherein the riser brackets of the pair of riser brackets are substantially identical to one another.

4. The modular staircase of claim 1, wherein each riser bracket is an integral, discrete, modular unit that is fabricated from a substantially rigid material.

5. The modular staircase of claim 4, wherein the first riser bracket and the second riser bracket are each fabricated from tubular metal.

6. The modular staircase of claim 1, wherein the first and second riser brackets each have a substantially trapezoidal configuration, such that the balustrade of each of the first and second riser brackets extends at a non-perpendicular angle with respect to the front baluster and the rear baluster of the respective one of the first riser bracket or the second riser bracket.

7. The modular staircase of claim 1, wherein the first and second support brackets of each tread extend in a generally horizontal direction, and the lower member of each riser bracket extends in a generally horizontal direction.

8. The modular staircase of claim 1, wherein the first and second support brackets extend downward from and substantially perpendicular to the foot engaging portion of the tread.

9. The modular staircase of claim 1, wherein the lower member of each riser bracket is positioned outward with respect to a respective one of the first support bracket and is rigidly connected thereto or the second support bracket by fasteners that extend through both the lower member of a respective riser bracket of the pair of riser brackets a respective one of the first support bracket and the second support bracket.

10. The modular staircase of claim 1, the lower member of each riser bracket having a side surface that is in direct facing engagement with a respective one of the first and second support brackets, wherein the side surface of each riser bracket is substantially perpendicular to a top surface of each riser bracket, and wherein a portion of the tread substantially overlies the lower member of each riser bracket such that the tread is at least partially supported by engagement of the tread with the lower member of each riser bracket.

11. A modular staircase, comprising:

a plurality of identical step modules, each step module having:

a tread having a substantially planar foot engaging portion, a first support bracket disposed along a first lateral side of the tread, and a second support bracket disposed along a second lateral side of the tread, and a pair of identical riser brackets each having a generally horizontal lower member that is disposed at a bottom end of each riser bracket and extends from a front end of each riser bracket to a rear end of each riser bracket, generally vertical front and rear balusters that are each connected to and extend generally upward from the lower member of each riser bracket at the front end and the rear end, respectively, of each riser bracket, wherein the lower member of each riser bracket extends along and is rigidly connected to a respective one of the first support bracket or the second support bracket of the tread, and further wherein a plurality of connector holes are formed through the front and rear balusters of each riser bracket in a front-to-rear direction with respect to the riser brackets, and a balustrade that extends between and is connected to the front baluster and the rear baluster of each riser bracket at a top end of each riser bracket;

the plurality of step modules including at least a first step module and a second step module; and a plurality of fasteners that rigidly connect the rear balusters of the first riser step module to the front balusters of the second step module at a selected vertical position of a plurality of possible vertical positions of the first step module with respect to the second step module.

12. The modular staircase of claim 11, wherein each riser bracket is an integral, discrete, modular unit that is fabricated from a substantially rigid material.

13. The modular staircase of claim 12, wherein the first riser bracket and the second riser bracket are each fabricated from tubular metal.

14. The modular staircase of claim 11, wherein the first and second riser brackets each have a substantially trapezoidal configuration, such that the balustrade of each of the first and second riser brackets extends at a non-perpendicular angle with respect to the front baluster and the rear baluster of the respective one of the first riser bracket or the second riser bracket.

15. The modular staircase of claim 11, wherein the first and second support brackets extend downward from and substantially perpendicular to the foot engaging portion of the tread.

16. The modular staircase of claim 11, wherein the lower member of each riser bracket is rigidly connected to a respective one of the first support bracket or the second support bracket by fasteners that extend through both the lower member of a respective riser bracket of the pair of riser brackets and a respective one of the first support bracket and the second support bracket.

17. The modular staircase of claim 11, the lower member of the each riser bracket having a side surface that is in direct facing engagement with a respective of the first and second support brackets, wherein the side surface of each riser bracket is substantially perpendicular to a top surface of each riser bracket, and wherein a portion of the tread substantially overlies the lower member of each riser bracket, such that the tread is at least partially supported by engagement of the tread with the lower member of each riser bracket.

* * * * *